US006662973B1

(12) United States Patent
Velliquette

(10) Patent No.: US 6,662,973 B1
(45) Date of Patent: Dec. 16, 2003

(54) FLUID FLOW CONTROL VALVE/SEAL FOR FLUID DISPENSERS

(76) Inventor: Stephen P. Velliquette, 4411 Bee Ridge Rd., #593, Sarasota, FL (US) 34233

( * ) Notice: Subject to any disclaimer, the term of this patent is extended or adjusted under 35 U.S.C. 154(b) by 0 days.

(21) Appl. No.: 10/188,638

(22) Filed: Jul. 2, 2002

(51) Int. Cl.[7] ..... B65D 37/00
(52) U.S. Cl. ..... 222/207; 222/496
(58) Field of Search ..... 222/207, 212, 222/496, 444, 449, 211

(56) References Cited

U.S. PATENT DOCUMENTS

| | | | | |
|---|---|---|---|---|
| 2,135,237 A | | 11/1938 | Lewis et al. | |
| 3,586,068 A | | 6/1971 | Nicholson | |
| 3,618,825 A | | 11/1971 | Clarke | |
| 3,878,972 A | * | 4/1975 | Por | 222/207 |
| 3,963,150 A | * | 6/1976 | Steiman et al. | 222/211 |
| 4,090,647 A | | 5/1978 | Dunning | |
| 4,179,051 A | | 12/1979 | Thomas | |
| 4,420,101 A | | 12/1983 | O'Neill | |
| 4,483,465 A | | 11/1984 | Lawrence | |
| 5,071,017 A | | 12/1991 | Stull | |
| D359,970 S | | 7/1995 | Szabo | |
| 5,492,253 A | | 2/1996 | Proshan | |
| 5,551,599 A | * | 9/1996 | Niss | 222/207 |
| 5,573,033 A | | 11/1996 | Litzel | |
| 5,641,233 A | | 6/1997 | Wilson | |
| 5,839,626 A | | 11/1998 | Gross et al. | |
| 5,927,566 A | | 7/1999 | Mueller | |
| 5,927,567 A | | 7/1999 | Fillmore | |
| 5,934,514 A | | 8/1999 | Lampe et al. | |
| 6,062,436 A | | 5/2000 | Fuchs | |
| 6,089,419 A | | 7/2000 | Gross | |
| 6,315,483 B1 | | 11/2001 | Velliquette | |

* cited by examiner

*Primary Examiner*—Philippe Derakshani
(74) *Attorney, Agent, or Firm*—Charles J. Prescott

(57) ABSTRACT

A fluid flow control valve for use in a fluid applicator tip which is connectable onto an open end of a resiliently squeezable bottle. The valve includes a valve body defining a flow aperture formed centrally therethrough. A separate sealing ball is held in coaxial alignment and spring biased seated retention against the flow aperture and oriented downstream of fluid flow through the flow aperture from the open end of the container. The valve is thus normally closed and opens or unseats automatically to permit fluid to flow through the fluid aperture when the bottle is held in at lease a somewhat inverted orientation and squeezed to increase fluid pressure against the spring biased sealing ball. The sealing ball automatically reseats when there is no substantial pressure within the bottle, preventing virtually all fluid flow and leakage.

4 Claims, 2 Drawing Sheets

FLUID FLOW CONTROL VALVE/SEAL FOR FLUID DISPENSERS

BACKGROUND OF THE INVENTION

1. Scope of Invention

This invention relates generally to fluid dispensers, and more particularly to a fluid flow control valve for also preventing inadvertent fluid spillage or leakage from such fluid dispensers.

2. Prior Art

In dispensing light fluids from a squeezable fluid dispenser, many times more fluid than needed is inadvertently forced from the bottle or reservoir. This occurs because there is no convenient means for instantly arresting the flow of fluid from the applicator tip or cap attached to the bottle itself when inverted for dispensing fluid. Such an applicator tip may take the form of a brush, a grout roller, a spout, a nozzle and the like. Many prior art devices have attempted to resolve this problem of excess fluid dispensing and dripping, but they have either been too expensive or difficult to manufacture or failed to operate as intended.

U.S. Pat. No. 5,927,566 invented by Mueller discloses a one-piece dispensing system for a container and a method for making same. The dispensing valve includes an orifice.

A dispensing structure with a lid containing a pressure-openable valve is disclosed in U.S. Pat. No. 6,089,419 invented by Gross. The lid includes a flexible valve with self-sealing slits which open to permit flow therethrough in response to pressure on the side of the valve.

Proshan, in U.S. Pat. No. 5,492,253, discloses a cap attachment having a flat disc with a socket adapted to receive the open end of the neck of a bottle. The disc has a slot centered therein and a vertical spout integral therewith.

U.S. Pat. No. 5,934,514 issued to Lampe, et al. teaches a dispensing valve closure which includes a self-sealing dispensing valve. An inner seal within the closure allows for sealing. Lawrence, in U.S. Pat. No. 4,483,465, teaches a valve for dispensing fluids. The valve housing has a diaphragm disposed therein having at least one aperture for allowing passage of fluids.

A one-piece check valve for use in an applicator tip for dispensing fluids is taught in U.S. Pat. No. 4,179,051 issued to Thomas. The valve comprises a reed and valve seat and a hinge section permitting the reed and valve seat to be folded over so that the reed portion seats on the seat provided by the valve seat portion. Fluid will pass through the check valve but any back-flow is prevented by engagement of the reed on the shoulder portion.

Stull, in U.S. Pat. No. 5,071,017 discloses a valve-type closure with a resilient diaphragm containing a slit for the passage of fluids. The slit portion has abuttable, cooperative structures on one side which come into forcible abutment and open the slit as the slit portion bulges.

O'Neill discloses a squeeze bottle with a self-venting dispensing closure in U.S. Pat. 4,420,101. The bottle cap contains a flexible disc having an annular valve being shiftable to positions upstream and downstream of the valve seat responsive to pressure within the bottle.

U.S. Pat. No. 5,573,033 teaches a non-drip valve for discharging liquid having at least one elastic member which reduces its volume when the pressure of the fluid increases thereby freeing the through-flow channel.

A flexible vented self-sealing dispensing valve is taught by Fuchs in U.S. Pat. 6,062,436. The self-sealing closure assembly includes a dispensing valve of one-piece integrally molded elastic construction with a mouth portion that includes a slit opening oriented diametrically of the annular base.

Dunning teaches a squeeze bottle container with a cap containing a tapered spout with an opening therethrough in U.S. Pat. No. 4,090,647. A closure cap is provided with a tongue to enhance the seal.

U.S. Pat. No. 5,839,626, issued to Gross, et al. teaches a closure having a dispensing valve with an orifice to permit liquid flow therethrough responsive to increased pressure within the container. An outer member on the base of the valve functions as a flow baffle for protecting the valve.

A one-piece valve adapted for use in pressurized containers for either charging the container or dispensing the contents therefrom is shown in U.S. Pat. No. 3,586,068. This fluid pressure responsive valve is made as a single unitary piece with fluid passage means formed therein and a plug which is compressible to seal the passages when fluid pressure forces are imposed on the valve. Design patent D359,970, issued to Szabo, discloses a plug cap having a slit therethrough.

Applicant's prior U.S. Pat. No. 6,315,483 teaches a one-piece fluid check valve having structure cooperative with the tip of a squeezable fluid dispensing container which automatically self closes the instant that squeezing pressure against the sides of the resilient container is released. Moreover, the invention thereafter allows air to re-enter the container, which has been squeezed and distorted, to resiliently return to its normal configuration without fluid spillage. Applicant has, however, discerned a problem with this invention in that the very feature which allows re-entry of air into the container also results in inadvertent leakage of fluid from the dispenser when not in use and when fluid is placed against the fluid check valve because of bottle orientation.

The present invention provides an improved fluid flow control valve of a squeezable fluid dispensing container which insures positive sealing of fluid within the container from advertent leakage while also regulating the flow of fluid when the container is squeezed in an inverted orientation.

BRIEF SUMMARY OF THE INVENTION

This invention is directed to a fluid flow control valve for use in a fluid applicator tip which is connectable onto an open end of a resiliently squeezable bottle. The valve includes a valve body defining a flow aperture formed centrally therethrough. A separate sealing ball is held in coaxial alignment and spring biased seated retention against the flow aperture and oriented downstream of fluid flow through the flow aperture from the open end of the container. The valve is thus normally closed and opens or unseats automatically to permit fluid to flow through the fluid aperture when the bottle is held in at lease a somewhat inverted orientation and squeezed to increase fluid pressure against the spring biased sealing ball. The sealing ball automatically reseats when there is no substantial pressure within the bottle, preventing virtually all fluid flow and leakage.

It is therefore an object of this invention to provide an economical, easy to install fluid control valve for use in fluid applicators having an applicator tip into which the device is insertable.

Still another object of the invention is to provide a fluid control valve for squeezable containers having an applicator tip which not only provides regulated flow and instant fluid flow stoppage, but also prevents any fluid leakage from the applicator tip.

In accordance with these and other objects which will become apparent hereinafter, the instant invention will now be described with reference to the accompanying drawings.

DETAILED DESCRIPTION OF THE INVENTION

Figure 1:
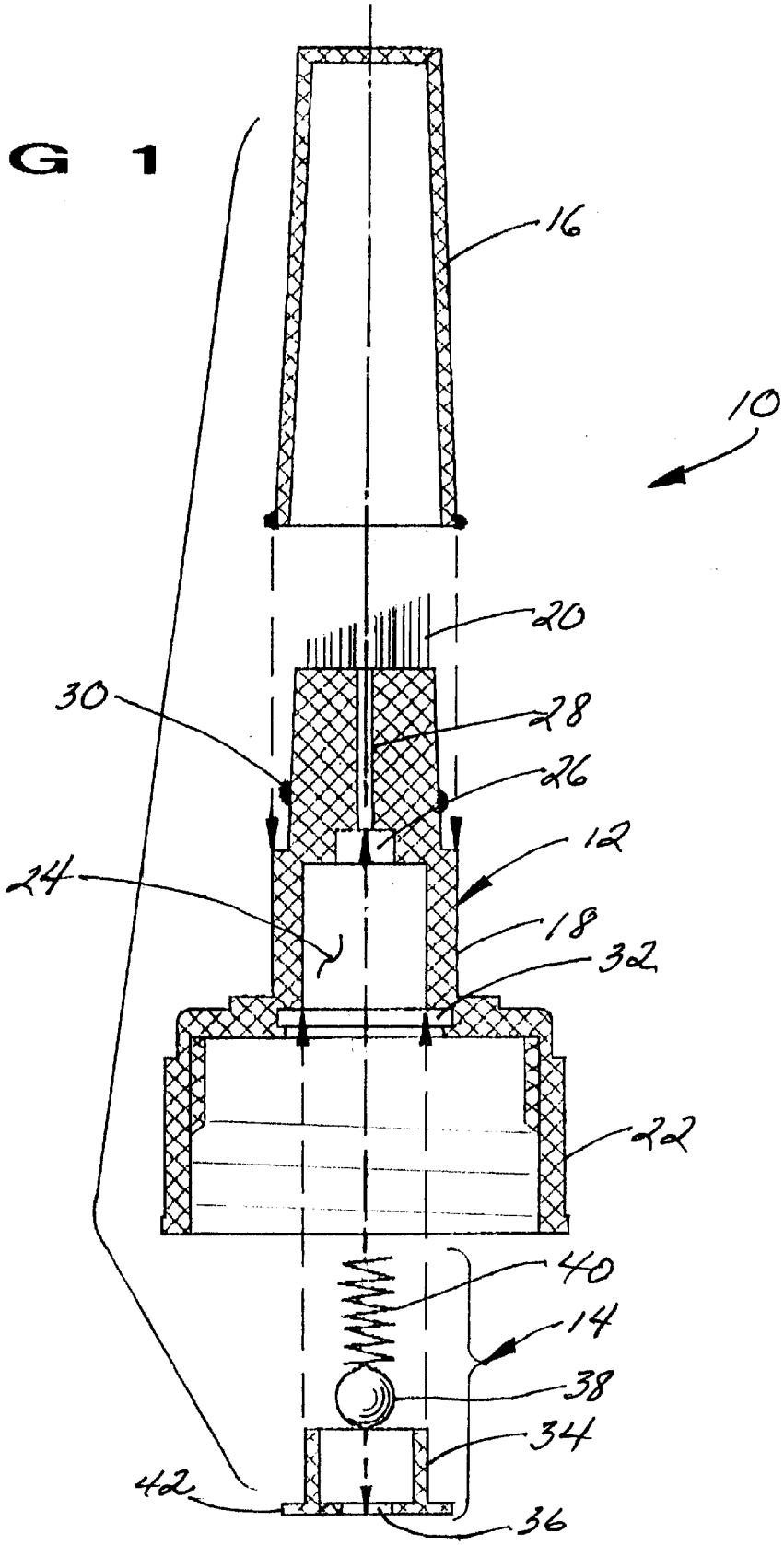
FIG. 1 is a side elevation exploded section view of one embodiment of the invention configured for installation into a cooperatively structured fluid applicator tip including a brush.

Referring now to the drawings and particularly to FIG. 1, one embodiment of the invention which is attachable to a squeezable container (not shown) is generally shown at numeral 10. The squeezable container is of a conventional nature typically made of molded plastic material and having a threaded neck. The fluid applicator tip 12 includes an internally threaded portion 22 which matably engages onto the open neck of the container in a conventional manner. The external size of the threaded portion 22 is reduced in stepped fashion as shown by hollow cylindrical segments 24, 26 and 28. Segment 24 has an interior surface configuration which matably and snugly receives a plastic valve body 34 of a fluid flow control valve shown generally at 14.

The distal or downstream end of the applicator tip 12 includes a molded brush tip 20 formed of flexible synthetic bristles which are heat formed together with a narrow elongated fluid passage 28 formed centrally there into for fluid passage from the applicator tip 12 into the bristles 20 for dispensing fluid onto a work surface. The fluid passage 28 also limits the maximum flow of fluid therethrough by design choice. A protective cap 16 covers the bristles when not in use.

The valve body 34, which may be resilient for enhanced sealing, includes a centrally aligned flow aperture 36 which is sized to be closed from fluid flow therethrough by a separate spherical sealing ball 38. A compression spring 40 which mates against the bottom of cavity 26 of the applicator tip portion 18, maintains a biased force against the sealing ball 38 so as to maintain sealing engagement with the flow aperture 36. The valve body 34 also includes a flange 42 which snapably engages into securing cavity 32 of the applicator tip 12. The main portion 34 of the valve body slidably engages into cavity 24 as flange 42 is engaged into the securing cavity 32.

In operation, the applicator tip 12, threadably attached to the neck of a fluid filled container (not shown) will allow fluid within the container to flow as the container is at least partially inverted so that fluid within the container is against the sealing ball 38 and at least partially within the flow aperture 36. My merely then squeezing the flexible container, fluid pressure is increased sufficiently to unseat the sealing ball 38 against this biased pressure produced by spring 40. Fluid will then flow through the elongated passageway 28 and through the bristles 24 for dispensing and spreading onto a working surface.

As should now be understood, a most important aspect of the invention is to prevent inadvertent fluid flow or spillage from the container. This is accomplished by the arrangement of the fluid flow control valve 14 and the sealing ball 38 thereof biasingly urged and maintained against the flow aperture 36 until such time as sufficient fluid pressure by bottle squeezing is produced to overcome the sealing spring biased pressure of the sealing ball 38 against the flow aperture 36. The protective cap 16 snapably engages onto an annular bead 30 formed around the applicator tip body 18 to protect the bristles when the device is not in use.

Figure 2:
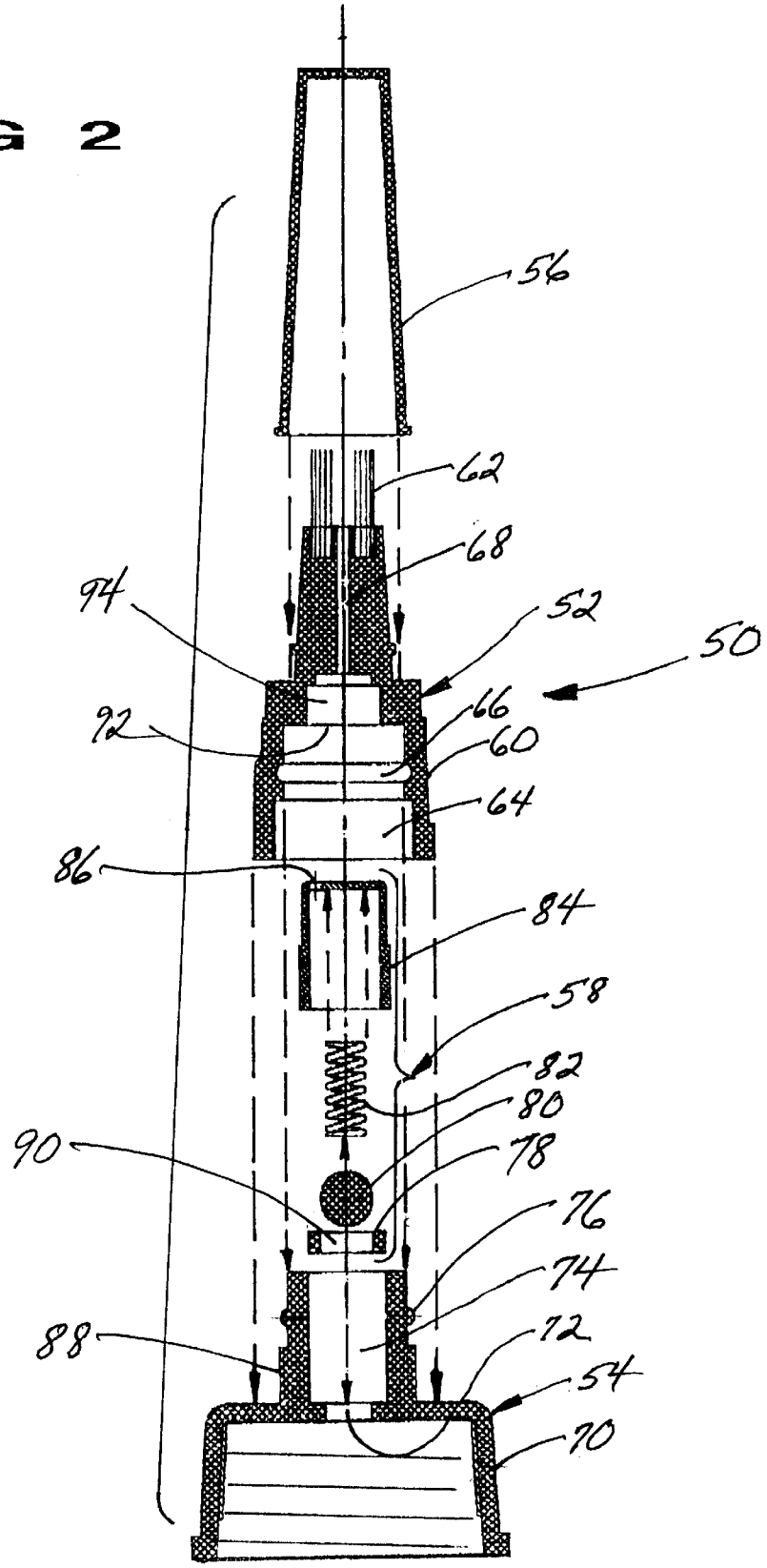
FIG. 2 is a side elevation exploded section view of an alternate embodiment of a fluid flow control valve similar to that shown in FIG. 1.

Referring now to FIG. 2, another embodiment of the invention is there shown generally at numeral 50 and includes an applicator tip 52 which is snapably engaged by undercut locking ring 66 onto an annular locking bead 76 of a bottle engaging portion 54. A fluid flow control valve shown generally at 58 includes a valve body 78 having a flow aperture 90 centrally formed therethrough which is sealably closed at its downstream side by a spherical sealing ball 80.

With the valve body 78 positioned at the bottom of cavity 74 of the container engaging member 54 in alignment with aperture 72, a biasing spring 82 acts to maintain the sealing ball 80 against the downstream side of flow aperture 90. A separate cup-shaped metering member 84 is snugly positioned within cavity 74 with the downstream end thereof against surface 92 and is provided with an orifice 86, preferably offset from the center of the metering member 84, which meters fluid flow and maximum fluid flow rate through the fluid flow control valve 58 into cavity 94 and fluid passage 68, the diameter or area of the metering orifice 86 being substantially smaller than that of flow aperture 90.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A fluid flow control valve for use in a fluid applicator tip which is connectable onto an open end of a resiliently squeezable bottle, comprising:

a valve body including a central flow aperture having a sealing seat;

a separate sealing ball configured for coaxial alignment and seated retention against said flow aperture and said sealing seat, respectively, within the applicator tip with said sealing ball oriented downstream of fluid flow through said flow aperture;

said valve body being normally biased closed by a spring acting against said sealing ball to permit fluid to flow through said flow aperture only when the bottle is squeezed to increase fluid pressure to unseat said sealing ball from said sealing seat;

said sealing ball automatically re-seating against said sealing seat when there is no substantial pressure within the bottle thus preventing substantially all fluid flow therethrough;

a metering cup positioned within the applicator tip between said spring and an elongated fluid passage of the fluid applicator tip and having a metering orifice formed through a bottom of said metering cup, said metering orifice being substantially smaller in diameter than that of said flow aperture whereby maximum fluid flow rate from the bottle through said fluid control valve is limited by said metering orifice.

2. A fluid control valve as set forth in claim 1, wherein:

said metering orifice is offset from a center of said metering cup for clearance from said spring.

3. In combination, a fluid flow control valve within a fluid applicator tip which is connectable onto an open end of a resiliently squeezable bottle, said flow control valve comprising:

a valve body including a central flow aperture having a sealing seat;

a separate sealing ball configured for coaxial alignment and seated retention against said flow aperture and said sealing seat, respectively, within the applicator tip with said sealing ball oriented downstream of fluid flow through said flow aperture;

said valve body being normally biased closed by a spring acting against said sealing ball to permit, fluid to flow through said flow aperture only when the bottle is squeezed to increase fluid pressure to unseat said sealing ball from said sealing seat;

said sealing ball automatically re-seating against said sealing seat when there is no substantial pressure within the bottle thus preventing substantially all fluid flow therethrough;

a metering cup positioned within the applicator tip between said spring and an elongated fluid passage of the fluid applicator tip and having a metering orifice formed through a bottom of said metering cup, said metering device being substantially smaller in area than that of said flow aperture whereby maximum fluid flow rate through said fluid control valve is regulated by said metering orifice.

4. A fluid control valve as set forth in claim 3, wherein:

said metering orifice is offset from a center of said metering cup for clearance from said spring.

* * * * *